US011933138B2

(12) United States Patent
Hou et al.

(10) Patent No.: US 11,933,138 B2
(45) Date of Patent: Mar. 19, 2024

(54) SLIDING SLEEVE DEVICE

(71) Applicants: CHINA PETROLEUM & CHEMICAL CORPORATION, Beijing (CN); SINOPEC SOUTHWEST OIL & GAS COMPANY, Sichuan (CN)

(72) Inventors: Zhimin Hou, Sichuan (CN); Dan Hu, Sichuan (CN); Qiang Wang, Sichuan (CN); Yijun Zhou, Sichuan (CN); Jiang Qian, Sichuan (CN); Chen Chen, Sichuan (CN); Tao Liu, Sichuan (CN); Jianfa Ci, Sichuan (CN); Wenfeng Pang, Sichuan (CN); Wenjiang Teng, Sichuan (CN)

(73) Assignees: CHINA PETROLEUM & CHEMICAL CORPORATION, Beijing (CN); SINOPEC SOUTHWEST OIL & GAS COMPANY, Sichuan (CN)

( * ) Notice: Subject to any disclaimer, the term of this patent is extended or adjusted under 35 U.S.C. 154(b) by 0 days.

(21) Appl. No.: 18/001,523

(22) PCT Filed: Jun. 10, 2021

(86) PCT No.: PCT/CN2021/099471

§ 371 (c)(1),
(2) Date: Dec. 12, 2022

(87) PCT Pub. No.: WO2021/249498

PCT Pub. Date: Dec. 16, 2021

(65) Prior Publication Data

US 2023/0313641 A1 Oct. 5, 2023

(30) Foreign Application Priority Data

Jun. 12, 2020 (CN) ..... 202010534832.7
Jun. 12, 2020 (CN) ..... 202010534864.7
Jun. 12, 2020 (CN) ..... 202010535615.X

(51) Int. Cl.
*E21B 34/14* (2006.01)

(52) U.S. Cl.
CPC ..... *E21B 34/14* (2013.01); *E21B 34/142* (2020.05)

(58) Field of Classification Search
CPC ..... E21B 34/14; E21B 34/142
See application file for complete search history.

(56) References Cited

U.S. PATENT DOCUMENTS 2,872,983 A 2/1959 Renouf
6,464,008 B1 10/2002 Roddy et al.
(Continued)

FOREIGN PATENT DOCUMENTS

CA 2781721 A1 * 9/2012 ..... B42F 7/02
CA 2983696 A1 * 5/2013 ..... E21B 34/063
(Continued)

OTHER PUBLICATIONS

Guo, Juanli et al.; "Anti-corrosion of Oil and Gas Pipelines in Crossing Section of Mountain Tunnel"; Gas & Heat; vol. 38, No. 10; Oct. 15, 2018; pp. 13-17.
(Continued)

*Primary Examiner* — James G Sayre
(74) *Attorney, Agent, or Firm* — NKL Law; Allen Xue

(57) ABSTRACT

A sliding sleeve device has an outer cylinder, a circulation hole being provided in the wall of the outer cylinder; and an inner cylinder provided in an inner cavity of the outer cylinder. In an initial state, the inner cylinder and the outer cylinder are fixed to each other to seal the circulation hole. In a first state, the inner cylinder is movable relative to the outer cylinder, thereby unsealing the circulation hole. A protection mechanism is provided in the circulation hole,
(Continued)

which has an inner member located on the radially inner side and an outer member located on the radially outer side.

8 Claims, 7 Drawing Sheets

(56) References Cited

U.S. PATENT DOCUMENTS

| | | | |
|---|---|---|---|
| 10,487,622 | B2 | 11/2019 | Nickles et al. |
| 2006/0065870 | A1 | 3/2006 | Mori et al. |
| 2014/0096970 | A1 | 4/2014 | Andrew et al. |
| 2016/0108711 | A1 | 4/2016 | Lynk |
| 2017/0218741 | A1* | 8/2017 | Arabskyy ..... E21B 17/1007 |
| 2019/0383117 | A1 | 12/2019 | Feng et al. |

FOREIGN PATENT DOCUMENTS

| | | | |
|---|---|---|---|
| CN | 2924164 | Y | 7/2007 |
| CN | 102966330 | A | 3/2013 |
| CN | 102966331 | A | 3/2013 |
| CN | 103148071 | A | 6/2013 |
| CN | 103261573 | A | 8/2013 |
| CN | 103375159 | A | 10/2013 |
| CN | 204283392 | U | 4/2015 |
| CN | 204386577 | U | 6/2015 |
| CN | 104968888 | A | 10/2015 |
| CN | 204851170 | U | 12/2015 |
| CN | 105645301 | A | 6/2016 |
| CN | 105672943 | A | 6/2016 |
| CN | 105783829 | A | 7/2016 |
| CN | 106030025 | A | 10/2016 |
| CN | 107939307 | A | 4/2018 |
| CN | 108060910 | A | 5/2018 |
| CN | 108386157 | A | 8/2018 |
| CN | 109138854 | A | 1/2019 |
| CN | 109138917 | A | 1/2019 |
| CN | 109209319 | A | 1/2019 |
| CN | 109267984 | A | 1/2019 |
| CN | 208950708 | U | 6/2019 |
| CN | 110080719 | A | 8/2019 |
| CN | 110130863 | A | 8/2019 |
| CN | 209212207 | U | 8/2019 |
| CN | 110325704 | A | 10/2019 |
| CN | 110374552 | A | 10/2019 |
| CN | 110529073 | A | 12/2019 |
| CN | 209959185 | U | 1/2020 |
| CN | 210033403 | U | 2/2020 |
| DE | 2623370 | A1 | 12/1976 |
| GB | 2164980 | A | 4/1986 |
| WO | 2012159702 | A1 | 11/2012 |
| WO | 2015117221 | A1 | 8/2015 |

OTHER PUBLICATIONS

Luo, Zhongshun; "Nuclear Technology Applications"; Harbin Engineering University Press; Jan. 30, 2015; pp. 181-182.

Xu, Bin; "Mechanical assembly technology"; China Light Industry Press, Aug. 8, 2014; pp. 86.

* cited by examiner

SLIDING SLEEVE DEVICE

CROSS REFERENCE TO RELATED APPLICATIONS

This application is a national stage entry of PCT international application No. PCT/CN2021/099471, filed on Jun. 10, 2021, which claims the priorities of Chinese patent application No. 202010534864.7, entitled "Sliding sleeve device and fracturing string containing the same" and filed on Jun. 12, 2020, Chinese patent application No. 202010535615.X, entitled "Fracturing sub and fracturing string containing the same" and filed on Jun. 12, 2020, and Chinese patent application No. 202010534832.7, entitled "Fracturing sub and fracturing string containing the same" and filed on Jun. 12, 2020, the content of each is incorporated herein by reference in its entirety.

TECHNICAL FIELD

The present invention relates to the technical field of oil and natural gas well completion, and in particular to a sliding sleeve device.

TECHNICAL BACKGROUND

With the continuous and deepening development in oil and gas exploitations, sliding sleeve has become one of the key tools to realize communication with the oil casing annulus in the process of cementing, completion and fracturing, for the sake of fracturing of separate layers.

During gas testing in the completion of oil and gas wells, the annulus between the pipe string and the wellbore can be accessed through opening the sliding sleeve, thus realizing operations such as circulation, fluid replacement, sand fracturing, and so on. For staged construction in multiple layers, it is necessary to arrange multiple sliding sleeves in series on one pipe string. During construction, the sliding sleeves are opened in sequence from bottom to top, and then corresponding layers are fractured one after another. In this manner, the fracturing can be performed successively in layers.

With the development of explorations and exploitations of tight gas reservoirs, the horizontal sections of horizontal wells are getting longer and longer, and the number of sand fracturing stages is also increasing. Fracturing process involving dozens of sliding sleeves has been implemented already. However, in the actual production process, the problem that the sliding sleeves cannot be opened smoothly often occurs, thus affecting the construction progress.

SUMMARY OF THE INVENTION

Aiming at some or all of the above technical problems existing in the prior arts, the present invention proposes a sliding sleeve device, which can ensure that the sliding sleeve can be opened smoothly for performing subsequent related operations.

According to the present invention, a sliding sleeve device is provided, comprising: an outer cylinder, with a circulation hole being provided in a wall of the outer cylinder; and an inner cylinder arranged in an inner cavity of the outer cylinder, wherein in an initial state, the inner cylinder and the outer cylinder are fixed to each other to close the circulation hole, and in a first state, the inner cylinder is movable relative to the outer cylinder to release closure of the circulation hole. A protective mechanism is provided in the circulation hole, and includes an inner member located on a radially inner side and an outer member located on a radially outer side.

In a preferred embodiment, the circulation hole comprises two steps formed on an outer wall of the outer cylinder and opposite to each other circumferentially, the outer member being configured to span over said two steps to block the circulation hole.

In a preferred embodiment, the inner member is lubricating grease filled in the circulation hole, and the outer member is a protective cover.

In a specific embodiment, a recess is provided on an outer wall of the inner cylinder, and at least partially located in the circulation hole in the initial state to allow the lubricating grease to enter the recess.

In a preferred embodiment, the protective cover is a heat-shrinkable cover or a resin cover.

In a preferred embodiment, the outer member is a breakable element to be ruptured under pressure, and the inner member is a support element to support the breakable element and fall off therefrom under pressure.

In a preferred embodiment, at least one protruding ring embedded in the breakable element is provided on the outer wall of the outer cylinder in a region between said two steps.

In a preferred embodiment, the breakable element is configured as a cement jacket formed by hardening of cement slurry supplied.

In a preferred embodiment, the support element is configured as a plurality of piled balls made of resin, or a plurality of piled balls made of metal soluble in working fluid.

In a preferred embodiment, the support element comprises multiple layers of balls, the balls being gradually reduced in layers along a direction from the radially inner side to the radially outer side.

In a specific embodiment, a layer of lubricating grease is provided on both the radially inner and outer sides of the support element.

In a preferred embodiment, the outer member is configured as a plug made of soluble material.

In a specific embodiment, a blind hole is provided on a radial inner surface of the plug.

In a preferred embodiment, the plug comprises a connecting segment and a sloping segment, which are located in sequence in a direction from the radially outer side to the radially inner side and connected with each other. The connecting segment is fixedly engaged with the circulation hole, while the sloping segment is configured to have a reduced size in the direction from the radially outer side to the radially inner side.

In a preferred embodiment, the outer member is configured as a breakable disk, which includes a main body portion fixedly connected to the circulation hole, and a disk portion that is breakable under pressure.

In a preferred embodiment, a clearance in communication with the circulation hole is provided between the outer cylinder and the inner cylinder and outside axial ends of the circulation hole.

In a preferred embodiment, the clearance is an enlarged hole formed on the inner wall of the outer cylinder, the enlarged hole comprising a sloping surface so that the clearance is narrowed in a direction away from the circulation hole.

BRIEF DESCRIPTION OF THE DRAWINGS

In the following preferred embodiments of the present invention will be described in detail with reference to the accompanying drawings. In the drawings.

In the drawings, the same reference numerals are used to indicate the same components. The drawings are not drawn to actual scale.

DETAILED DESCRIPTION OF EMBODIMENTS

The present invention will be further described below with reference to the accompanying drawings. In the context of the present invention, directional terms "upper", "upstream", "upward" or the like refer to a direction toward the well head, while directional terms "down", "downstream", "downward" or the like refer to a direction away from the well head. In addition, the direction along the length of the sliding sleeve device is indicated as "longitudinal direction" or "axial direction", and the direction perpendicular to the "longitudinal direction" or "axial direction" is indicated as "radial direction", wherein the orientation of the radial direction toward the formation is indicated as "radially outside" while the orientation thereof away from the formation is indicated as "radially inside".

Figure 1:
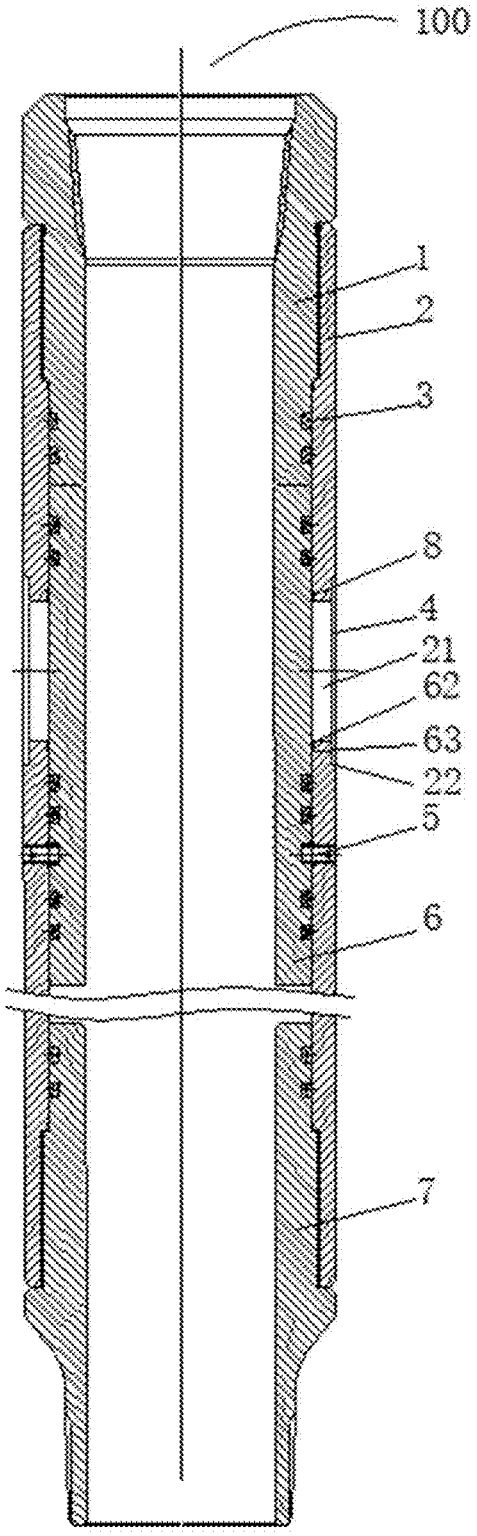
FIG. 1 shows a sliding sleeve device according to a first embodiment of the present invention, wherein the sliding sleeve device is in an initial state.

FIG. 1 shows a sliding sleeve device 100 according to a first embodiment of the present invention. As shown in FIG. 1, the sliding sleeve device 100 includes an outer cylinder 2 and an inner cylinder 6. A circulation hole 21 which can communicate the inside with the outside is provided on the wall of the outer cylinder 2, for providing a channel for fracturing operation. The circulation hole may also be called as fracturing hole, flow guiding hole, or the like. The inner cylinder 6 is arranged in an inner cavity of the outer cylinder 2. For example, the inner cylinder 6 can be arranged on an inner wall of the outer cylinder 2 through a shear pin 5, and thus fixedly connected with the outer cylinder 2. In an initial state of the sliding sleeve device 100 as shown in FIG. 1, the inner cylinder 6 closes the circulation hole 21. After the inner cylinder 6 is subjected to an axially downward force reaching the shearing pressure of the shear pin 5, the shear pin 5 is sheared off, so that the inner cylinder 6 can move downward relative to the outer cylinder 2, thereby releasing the closure of the circulation hole 21 from the inside. That is, the circulation hole 21 is opened.

Figure 2:
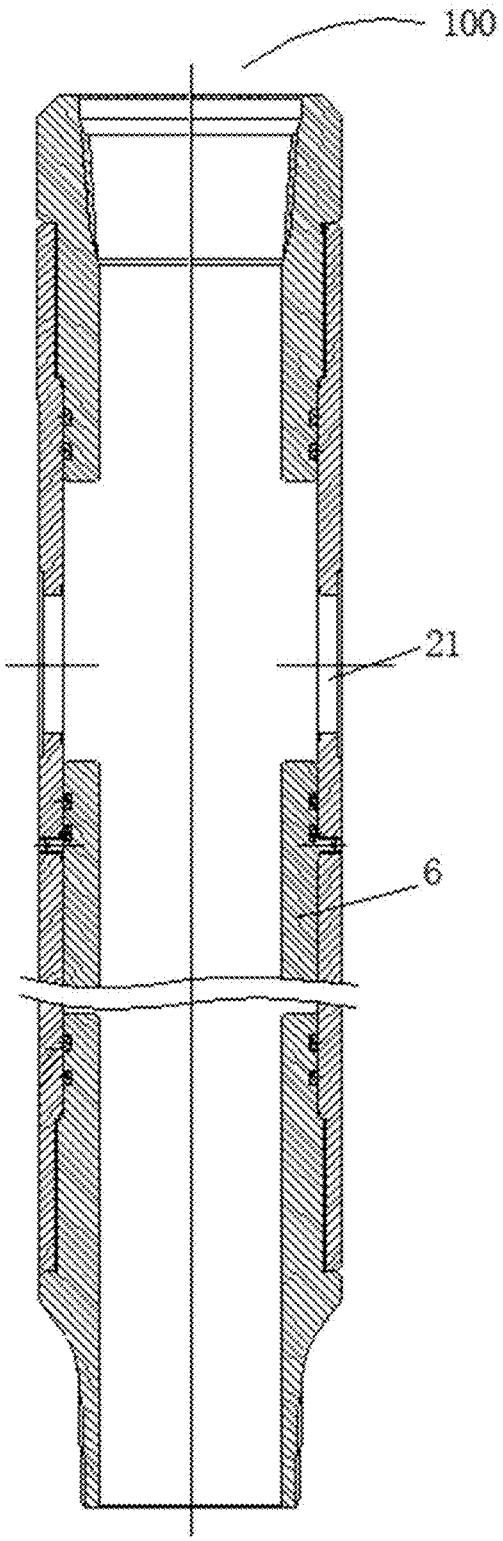
FIG. 2 shows the sliding sleeve device of FIG. 1 in a first state.

FIG. 2 shows a first state of the sliding sleeve device 100. In the first state, the closure of the circulation hole 21 by the inner cylinder 6 is released, that is, the circulation hole 21 is opened. After that, the operation of pumping fracturing fluid can be carried out. After pumping the fracturing fluid, the sliding sleeve device 100 is in a second state (not shown).

The structure, operations and states of the sliding sleeve device as mentioned above are well known to one skilled in the art, and thus detailed description thereof are omitted here.

Figure 3:
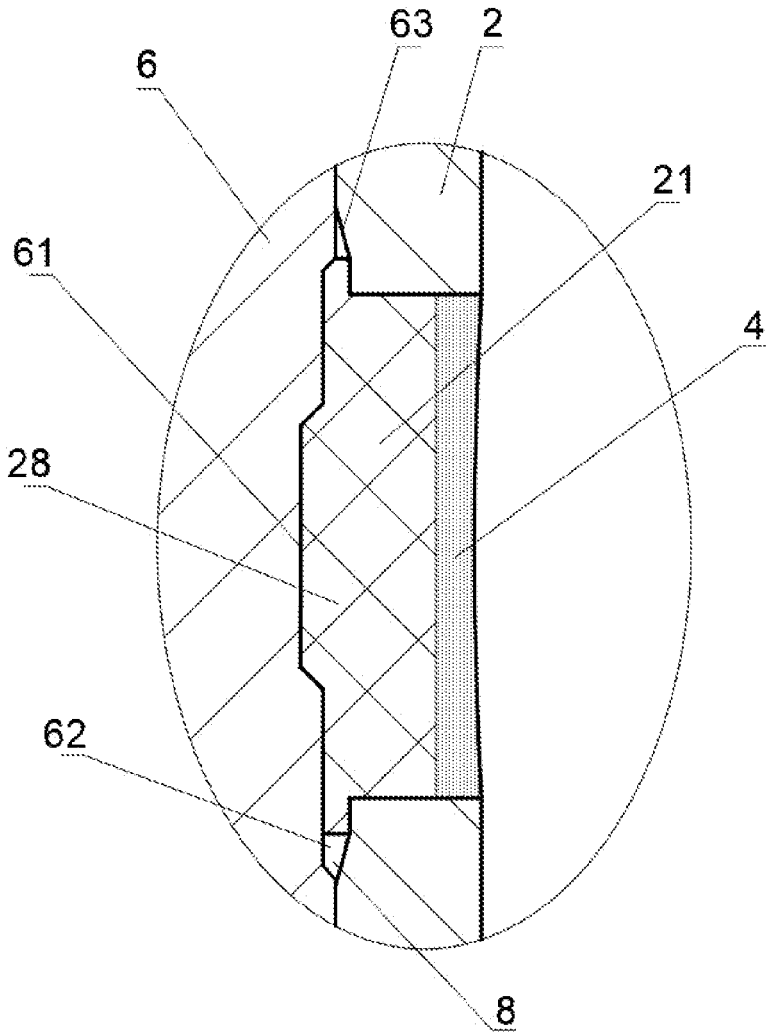
FIG. 3 is an enlarged view of the sliding sleeve device of FIG. 1, showing an area where a circulation hole is located.

FIG. 3 is an enlarged view of the sliding sleeve device 100 as shown in FIG. 1, showing an area near the circulation hole 21. According to the present invention, the circulation hole 21 is filled with lubricating grease 28. On the one hand, the lubricating grease 28 occupies the space of the circulation hole 21, preventing or reducing impurities from entering the area between the inner cylinder 6 and the outer cylinder 2. On the other hand, when the inner cylinder 6 moves relative to the outer cylinder 2, the lubricating grease 28 can enter the area between the inner cylinder 6 and the outer cylinder 2 for providing lubrication. In this manner, the inner cylinder 6 can move relative to the outer cylinder 2 more smoothly, ensuring smooth opening of the inner cylinder 6.

According to an embodiment of the present invention, a recess 61 is provided on the outer wall of the inner cylinder 6, as shown in FIG. 3. In the initial state, the recess 61 is located on the outer wall of the inner cylinder 6 at a position corresponding to the circulation hole 21. In this way, the lubricating grease 28 can be filled not only in the circulation hole 21 but also in the recess 61. When the inner cylinder 6 moves downward relative to the outer cylinder 2, the recess 61 will facilitate the lubricating grease 28 to enter the area between the inner cylinder 6 and the outer cylinder 2, thereby further ensuring the lubricating effect. Preferably, the recess 61 is formed as a stepped groove.

As shown in FIG. 3, according to a preferred embodiment of the present invention, a clearance 8 in communication with the circulation hole 21 is formed between the outer cylinder 2 and the inner cylinder 6 but outside the axial ends of the circulation hole 21. The clearance 8 may be formed only on the inner wall of the outer cylinder 2, or only on the outer wall of the inner cylinder 6, or on both. In a specific embodiment, an enlarged hole 62 may be provided on the inner wall of the outer cylinder 2 immediately outside the circulation hole 21. A wall surface of the enlarged hole 62 is preferably configured to have a sloping surface 63, so that the clearance 8 narrows in both directions axially away from the circulation hole 21. On the one hand, the above structure enables the lubricating grease 28 to easily enter the clearance 8, so that the lubricating grease 28 can be smoothly driven to the area between the inner cylinder 6 and the outer cylinder 2 following the movement of the inner cylinder 6. In this manner, the lubrication between the inner cylinder 6 and the outer cylinder 2 is improved, which further ensures the smooth downward movement of the inner cylinder 6. On the other hand, the sloping surface 63 ensures the clearance 8 is gradually smaller in size, which acts as a barrier to prevent impurities from entering the area between the inner cylinder 6 and the outer cylinder 2.

In one embodiment, as shown in FIG. 3, a protective cover 4 for blocking the circulation hole 21 is provided on the outer wall of the outer cylinder 2, in order to prevent the lubricating grease 28 in the circulation hole 21 from flowing out and also prevent impurities from flowing in the circulation hole 21 to contaminate the lubricating grease 28. In the initial state and the first state of the sliding sleeve device 100, the protective cover 4 blocks the circulation hole 21, while in the second state of the sliding sleeve device 100, the protective cover 4 is ruptured under the action of the fracturing fluid, so that the circulation hole 21 is opened.

In a specific embodiment, the protective cover 4 is a heat-shrinkable cover disposed on the outer wall of the outer cylinder 2. Preferably, the heat-shrinkable cover has a thickness of 0.5-2 mm, and two ends overlapping with the outer wall of the outer cylinder 2 at a length of no less than 5 cm. In this way, the protective cover 4 can not only function to protect the lubricating grease, but also be ruptured under the action of the fracturing fluid to expose the circulation hole 21. That is, no special breaking tool is required for such protective cover 4. As long as the fracturing fluid is supplied, the protective cover 4 will be ruptured under the action of pressure to expose the circulation hole 21, which greatly simplifies the operations.

In an alternative embodiment, the protective cover 4 may also be configured as a rubber cover vulcanized on the outer wall of the outer cylinder 2.

In a particular embodiment, as shown in FIG. 1, two step faces 22 opposite to each other are provided on the outer wall of the outer cylinder 2. The two step faces 22 are located at opposite positions along the circumferential direction of the circulation hole 21, respectively. In this way, the protective cover 4 can span over the two step faces 22. With the above arrangement, the outer wall of the protective cover 4 will not protrude from the outer wall of the outer cylinder 2, thereby ensuring safety of the protective cover 4, and avoiding the situation that the protective cover 4 is accidentally damaged when the sliding sleeve device 100 is lowered.

Preferably, the heat-shrinkable cover is formed by composite molding of irradiation cross-linked polyolefin base material and special hot-melt sealing adhesive. During the process of production and installation, the heat-shrinkable cover is arranged on the outer cylinder 2 by means of hot baking. For example, before installation, the outer wall surface of the outer cylinder 2 between the step faces 22 is sandblasted and derusted to a level of Sa2.5, and then the heat-shrinkable cover is placed around the outer cylinder 2. After that, the heat-shrinkable cover is heated and baked, so that it is stably arranged on the outer cylinder 2. The hot baking process can be carried out from the middle to both ends, and the heat-shrinkable cover can be rolled back and forth with a roller for air release.

In an alternative embodiment, the protective cover 4 is configured as a resin cover provided at the circulation hole 21. For example, the resin cover may have a thickness of 0.5-2 mm. Similarly, in this way, the protective cover 4 can not only function to protect the lubricating grease, but also be ruptured under the action of the fracturing fluid to expose the circulation hole 21. That is, no special breaking tool is required for such protective cover 4. As long as the fracturing fluid is supplied, the protective cover 4 will be ruptured under the action of pressure to expose the circulation hole 21, which greatly simplifies the operations.

The resin cover can be formed by dual-component epoxy resin or epoxy resin powder commonly available in the market. For example, the dual-component epoxy resin contains components A and B, wherein component A includes epoxy resin, leveling agent, diluent, plasticizer, toughening agent, filler or the like, while component B includes curing agent, promoter, diluent, filler or the like. In operation, component A and component B are firstly mixed with each other uniformly according to a ratio of 1:1, then filled into the circulation hole 21, and dried naturally. When solid epoxy resin powder is adopted, it can be filled into the circulation hole 21 with a powder spraying system, and then heat-cured through a drying and curing system.

It should note that when the resin cover is adopted, it is only necessary to fill the resin material in the circulation hole 21, no matter whether the resin material is liquid or solid. The protective cover 4 thus formed does not have to be overlapped onto the outer wall of the outer cylinder 2, and therefore step faces 22 are unnecessary in this case.

In addition, as shown in FIG. 1, the sliding sleeve device 100 further includes an upper joint 1 and a lower joint 7. The lower end face of the upper joint 1 extends into the inner cavity of the outer cylinder 2, and is fixedly connected with the outer cylinder 2. For example, internal threads are formed on the inner wall of the upper end of the upper joint 1 for connection. The lower joint 7 is arranged at the lower end of the outer cylinder 2, and is fixedly connected thereto. At the same time, the upper end face of the lower joint 7 extends into the inner cavity of the outer cylinder 2 to form a receiving platform, for receiving the inner cylinder 6 during the downward movement of the inner cylinder 6. For example, external threads are provided on the outer wall of the lower end of the lower joint 7 for connection.

Moreover, the sliding sleeve device 100 may further include at least one sealing ring 3. For example, a plurality of sealing rings 3 may be arranged between the inner cylinder 6 and the outer cylinder 2, which are located at positions adjacent to axial ends of the circulation hole 21 and those of the shear pin 5.

Figure 4:
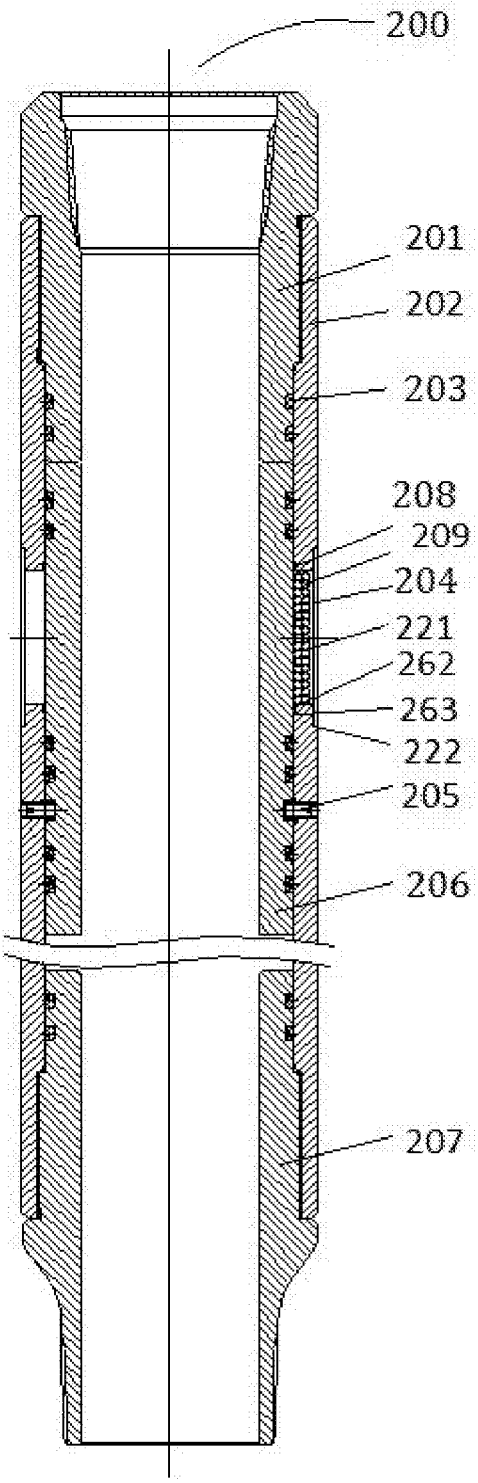
FIG. 4 shows a sliding sleeve device according to a second embodiment of the present invention, wherein the sliding sleeve device is in an initial state.

FIG. 4 shows a sliding sleeve device 200, which may also be referred to as a fracturing sub, according to a second embodiment of the present invention. As shown in FIG. 4, the sliding sleeve device 200 includes an outer cylinder 202 and an inner cylinder 206. A circulation hole 221 which can communicate the inside with the outside is provided on the wall of the outer cylinder 202, for providing a channel for fracturing operation. The inner cylinder 206 is arranged in an inner cavity of the outer cylinder 202. For example, the inner cylinder 206 can be arranged on an inner wall of the outer cylinder 202 through a shear pin 205, and thus fixedly connected with the outer cylinder 202. In an initial state of the sliding sleeve device 200 as shown in FIG. 4, the inner cylinder 206 closes the circulation hole 221. After the inner cylinder 206 is subjected to an axially downward force reaching the shearing pressure of the shear pin 205, the shear pin 205 is sheared off, so that the inner cylinder 206 can move downward relative to the outer cylinder 202, thereby releasing the closure of the circulation hole 221 from the inside. That is, the circulation hole 221 is opened.

In addition, as shown in FIG. 4, the sliding sleeve device 200 further includes an upper joint 201, a lower joint 207, and multiple sealing rings 203 arranged between the inner cylinder 206 and the outer cylinder 202. Their structures and positions are similar to those described in the first embodiment of the present invention, and thus detailed descriptions thereof are omitted here.

Figure 5:
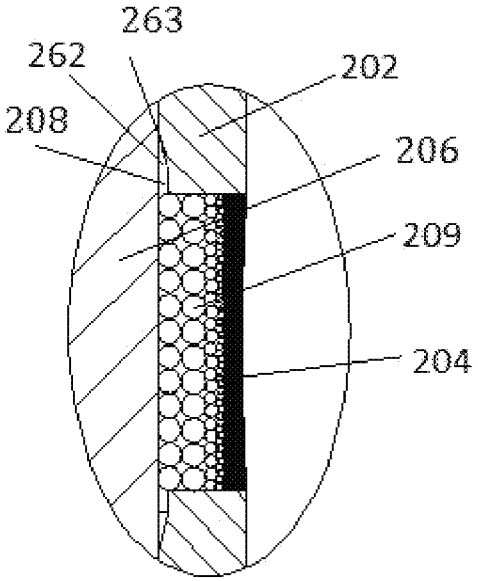
FIG. 5 is an enlarged view of the sliding sleeve device of FIG. 4, showing an area where a circulation hole is located.

FIG. 5 is an enlarged view of the sliding sleeve device 200 of FIG. 4, showing an area near the circulation hole 221. According to the present invention, a breakable element 204 is provided at the circulation hole 221, in order to block the circulation hole 221 in the initial state of the sliding sleeve device 200, thus preventing impurities from entering the circulation hole 221 before fracturing operation. After the inner cylinder 206 moves downward, the breakable element 204 can be ruptured in response to the pressure in the sliding sleeve device 200, thereby exposing the circulation hole 221 for the fracturing operation.

With the breakable element 204, impurities and the like can be effectively prevented from entering the circulation hole 221, and thus cannot enter in the area between the inner cylinder 206 and the outer cylinder 202, thereby ensuring the smooth downward movement of the inner cylinder 206. In particular, when the sliding sleeve device 200 is used in a well-cementing operation integrated with well-completion, the provision of the breakable element 204 can prevent the cement slurry from being accumulated in the circulation hole 221. Accordingly, the cement slurry cannot be solidified in the circulation hole 221 to block the circulation hole 221, so that the risk that the inner cylinder 206 cannot move downward is greatly reduced.

In one particular embodiment, the breakable element 204 is configured as a cement jacket formed by curing of the cement slurry applied. The cement jacket may have a thickness of 2-8 mm, for example, 3 mm. This arrangement is simple to achieve, whereby the breakable element 204 has a high hardness. Therefore, during the procedure of lowering the sliding sleeve device 200 or the cementing procedure, the breakable element 204 can satisfactorily protect the circulation hole 221, preventing impurities from entering therein. At the same time, the breakable element 204 is relatively brittle, and will be easily broken under the pressure of the fracturing fluid, so that normal fracturing operation will not be influenced. Moreover, the breakable element 204 can be formed with a simple process. For example, cement material can be supplied in situ, so that the breakable element 204 can be formed after curing of the cement. Therefore, the breakable element 204 can be provided without restrictions of the site, and the operation can be performed in real time at low cost.

According to the present invention, as shown in FIG. 5, in the circulation hole 221, a support element 209 is further provided at a radially inner side of the breakable element 204. The support element 209 is used to support the breakable element 204, in order to prevent the breakable element 204 from being ruptured ahead of time, thereby improving safety. Meanwhile, instead of being fixed in the circulation hole 221, the support element 209 is configured to be fallen off therefrom under pressure, so as not to hinder the fracturing operation.

In this way, with the support element 209, the breakable element 204 can be supported from the radially inner side of the circulation hole 221, so as to avoid breakage of the breakable element 204 ahead of time, thereby improving safety.

The support element 209 is filled in the circulation hole 221, which, on the one hand, occupies the space of the circulation hole 221 and thus prevents or reduces impurities from entering the area between the inner cylinder 206 and the outer cylinder 202. On the other hand, the support element 209 functions to support the breakable element 204, thus protect the breakable element 204 from being ruptured when being squeezed.

In a preferred embodiment, the support element 209 is configured as a plurality of metal balls or resin balls piled together. For example, the metal or resin balls may have a diameter of 1-2 mm. In addition to providing support and occupying space, the support element 209 can be easily flushed into the annulus after the breakable element 204 is broken during the procedure of pumping fracturing fluid, thereby exposing the circulation hole 221 completely.

Preferably, the support element 209 is made of soluble material, such as, one of soluble magnesium alloy, soluble aluminum alloy, and soluble resin. In this way, after being flushed into the annulus, the support element 209 will react with wellbore fluid and then be dissolved. This arrangement can effectively avoid influence on the construction by the support element 209 being brought into the formation, or avoid blocking problem caused by support element 209 returning to the wellhead, or the like. More preferably, the support element 209 is formed with holes to increase the contact area of the support element 209 with the wellbore fluid, so as to ensure uniform, rapid and complete dissolution thereof.

It should note that the support element 209 can be formed with other components or substances. For example, the circulation hole 221 is filled with semi-solid lubricating grease, which can play not only a lubricating role but also a supporting role. It should also note that the support element 209 can be configured not only in a spherical shape, but also in other shapes, such as a square shape, a cone shape, or the like. In addition, the holes of the support element 209 may be through holes or blind holes, or one or more holes.

In a particular embodiment, when the support element 209 is configured as a plurality of balls, the diameter of the support element 209 gradually decreases in a direction from the radially inner side to the radially outer side of the sliding sleeve device 200. Specifically, in the radial direction from the inside to the outside, the support elements 209 are arranged in layers, wherein the support elements 209 of the innermost layer have the largest diameter for improving the support strength, while those of the outermost layer have the smallest diameter for reducing the gap between the support elements 209 to prevent the breakable element 204 formed by the cement slurry from intruding into the gap between the support elements 209 excessively.

Preferably, in order to prevent the cement slurry from intruding into the gap of the support element 209 when being supplied, lubricating grease may be provided on both radial sides of the support element 209, that is, between the support element 209 and the breakable element 204, and between the support element 209 and the inner cylinder 206. The lubricating grease located between the support element 209 and the breakable element 204 can prevent the cement slurry from intruding into the gap of the support element 209, thereby effectively controlling the design thickness of the cement plug and ensuring that the breakable element 204 can be completely ruptured. The lubricating grease located between the support element 209 and the inner cylinder 206 can play a lubricating role, so as to ensure the smooth downward movement of the inner cylinder 206 relative to the outer cylinder 202.

In a particular embodiment, as shown in FIG. 4, two step faces 222 opposite to each other are provided on the outer wall of the outer cylinder 202. The two step faces 222 are located at opposite positions at both axial ends of the circulation hole 21, respectively. In this way, the breakable element 204 can span over the two step faces 222. With the above arrangement, the outer wall of the breakable element 204 will not protrude from the outer wall of the outer cylinder 202, thereby ensuring safety of the protective cover 204, and avoiding the situation that the breakable element 204 is accidentally damaged when the sliding sleeve device 200 is lowered.

In a preferred embodiment, a plurality of protruding rings (not shown) is provided on the outer wall of the outer cylinder 202 between the step faces 222. In this way, after the cement slurry is cured to form the breakable element 204, the protruding rings will be embedded in the breakable element 204. For example, the protruding ring may be one formed by processing the outer wall of the outer cylinder 202, or threads formed on the outer wall of the outer cylinder 202 by machining, or one formed on the outer wall of the outer cylinder 202 by welding, or a rubber ring or the like arranged around the outer wall of the outer cylinder 202. On the one hand, with the protruding rings, the friction between the cement slurry and the outer cylinder 202 can be enhanced, so as to ensure that the breakable element 204 can be more stably fixed on the outer cylinder 202, thereby ensuring safety. On the other hand, the protruding rings can provide sealing effect to effectively prevent impurities from entering the circulation hole 221 through the gap between the breakable element 204 and the outer cylinder 202, thereby effectively preventing impurities from entering the area between the inner cylinder 206 and the outer cylinder 202.

As an additional arrangement, as shown in FIG. 4, a clearance 208 in communication with the circulation hole 221 is formed between the outer cylinder 202 and the inner cylinder 206, and located outside two axial ends of the circulation hole 221. In a specific embodiment, an enlarged hole 262 may be provided on the inner wall of the outer cylinder 202 immediately outside the circulation hole 221. A wall surface of the enlarged hole 262 is preferably configured to have a sloping surface 263, so that the clearance 208 narrows in both directions axially away from the circulation hole 221. On the one hand, the above structure enables the lubricating grease to easily enter the clearance 208, so that the lubricating grease can be smoothly driven to the area between the inner cylinder 206 and the outer cylinder 202 following the movement of the inner cylinder 206. In this manner, the lubrication between the inner cylinder 206 and the outer cylinder 202 is improved, which further ensures the smooth downward movement of the inner cylinder 206. On the other hand, the sloping surface 263 ensures the clearance 208 is gradually smaller in size, which acts as a barrier to prevent impurities from entering the area between the inner cylinder 206 and the outer cylinder 202.

Figure 6:
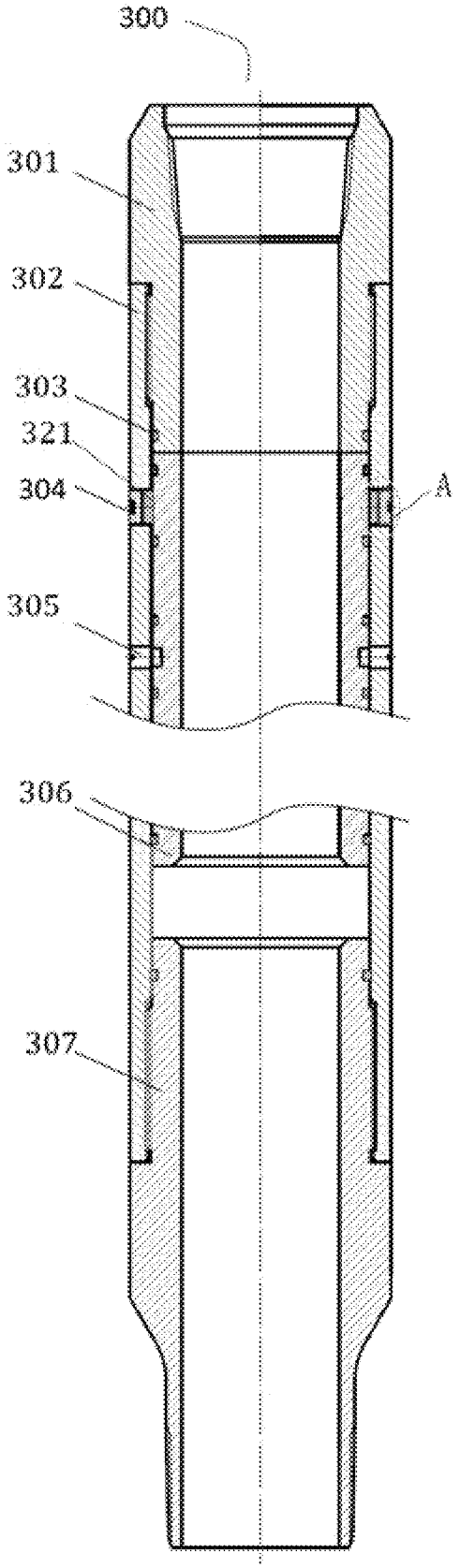
FIG. 6 shows a sliding sleeve device according to a third embodiment of the present invention, wherein the sliding sleeve device is in an initial state.

FIG. 6 shows a sliding sleeve device 300, which may also be referred to as a fracturing sub, according to a third embodiment of the present invention. As shown in FIG. 6, the sliding sleeve device 300 includes an outer cylinder 302 and an inner cylinder 306. A circulation hole 321 which can communicate the inside with the outside is provided on the wall of the outer cylinder 302, for providing a channel for fracturing operation. The inner cylinder 306 is arranged in an inner cavity of the outer cylinder 302. For example, the inner cylinder 306 can be arranged on an inner wall of the outer cylinder 302 through a shear pin 305, and thus fixedly connected with the outer cylinder 302. In an initial state of the sliding sleeve device 300 as shown in FIG. 6, the inner cylinder 306 closes the circulation hole 321. After the inner cylinder 306 is subjected to an axially downward force reaching the shearing pressure of the shear pin 305, the shear pin 305 is sheared off, so that the inner cylinder 306 can move downward relative to the outer cylinder 302, thereby releasing the closure of the circulation hole 321 from the inside. That is, the circulation hole 321 is opened.

In addition, as shown in FIG. 6, the sliding sleeve device 300 further includes an upper joint 301, a lower joint 307, and multiple sealing rings 303 arranged between the inner cylinder 306 and the outer cylinder 302. Their structures and positions are similar to those described in the first embodiment of the present invention, and thus detailed descriptions thereof are omitted here.

According to the present invention, a protective element 304 is further provided at the circulation hole 321, as shown in FIG. 6. The protective element 304 is used to block the circulation hole 321 in the initial state of the sliding sleeve device 300, so as to prevent impurities from entering the circulation hole 321 before the fracturing operation. According to the present invention, the protective element 304 is configured to expose the circulation hole 221 after the inner cylinder 306 moves downward to release the closure of the circulation hole 321, so that the fracturing operation can be carried out.

With the protective element 304, impurities and the like can be effectively prevented from entering the circulation hole 321, and thus cannot enter in the area between the inner cylinder 306 and the outer cylinder 302, thereby ensuring the smooth downward movement of the inner cylinder 306. In particular, when the sliding sleeve device 300 is used in a well-cementing operation integrated with well-completion, the provision of the protective element 304 can prevent the cement slurry from being accumulated in the circulation hole 321. Accordingly, the cement slurry cannot be solidified in the circulation hole 321 to block the circulation hole 321, so that the risk that the inner cylinder 306 cannot move downward is greatly reduced.

The specific structure of the protective element 304 in the sliding sleeve device 300 according to the third embodiment of the present invention will be described in detail below with reference to FIGS. 7 to 9.

In one embodiment, the protective element 304 is configured as a plug, made of a soluble material, which can block the circulation hole 321 from the outside. The plug may partially fill with the circulation hole 321, as shown in FIG. 7, or almost completely fill with the circulation hole 321, as shown in FIG. 8. In a particular example, the inner cylinder 306 is configured to receive a ball. In operation, after the ball is thrown into the inner cylinder 306, pressure is built up to shear off the shear pin 305, and the inner cylinder 306 moves downward under the pressure, thus releasing the blocking on the circulation hole 321 by the inner cylinder 306 from the inside. At this time, dissolving liquid can be pumped into the inner cavity of the sliding sleeve device 300, so that the protective element 304 in form of a plug is dissolved, thereby exposing the circulation hole 321. In this case, the fracturing operation can be performed at a level of the formation where the sliding sleeve device 300 is located.

Preferably, the plug may be made of magnesium alloy or aluminum alloy, and the dissolving liquid may be an acid solution or a solution containing chloride ions. It should note that dissolving duration of the plug can be adjusted by appropriately selecting the material of the plug, components and concentration of the solution, or the like, thereby controlling the fracturing time.

In one embodiment, a blind hole (not shown) extending radially outward (i.e., along the direction of arrow B in FIG. 7) is provided on a radially inner surface of the plug. For example, several blind holes distributed evenly can be provided on the radially inner surface of the plug. Alternatively, only a blind hole can be provided in the center of the plug. In this way, the contact area between the dissolving liquid and the plug can be increased, so that the plug can be dissolved uniformly, rapidly and completely, thus avoiding incomplete dissolution of the plug which may hinder the fracturing operation in later stages.

Alternatively or additionally, a groove 348 extending in a radial direction of the sliding sleeve device can also be provided along a circumferential direction of the plug per se. In this way, the dissolving liquid can especially enclose an outer wall of at least one end of the plug, so as to ensure that the plug is in contact with the dissolving liquid in all directions from the radially outer side to the radially inner side during the dissolving procedure. Accordingly, the plug can be dissolved uniformly, rapidly, and completely.

Figure 7:
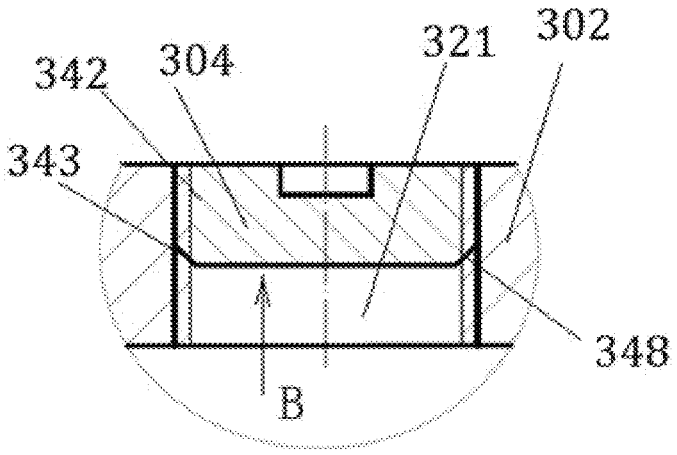
FIG. 7 shows an enlarged view of area A in FIG. 6 in a form.
Figure 8:
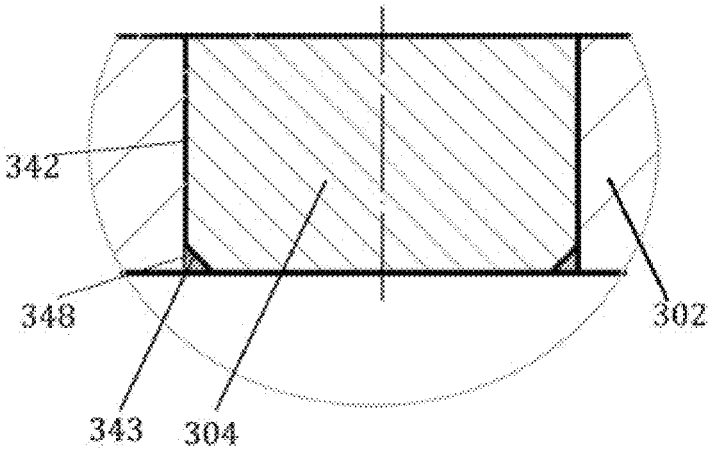
FIG. 8 shows an enlarged view of area A in FIG. 6 in another form.

Preferably, the plug comprises a connecting segment 342 and a sloping segment 343, which are located in sequence in the direction from the radially outer side to the radially inner side and connected with each other, as shown in FIGS. 7 and 8. The connecting segment 342 is fixedly engaged with the circulation hole 321, while the sloping segment 343 is configured to have a reduced size in the radial direction from the outside to the inside, thus forming a gap in between with the wall of the circulation hole 321, so as to facilitate the entry of the dissolving liquid. For example, a ratio of the length of the connecting segment 342 to that of the bevel segment 343 is 0.5:1-1:1. Preferably, the connection between the connecting segment 342 and the circulation hoe 321 is formed as screw fit or interference fit, and the outer surface of the plug and the outer surface of the outer cylinder 302 are on the same arc surface. With this structure, during the procedure of lowering the sliding sleeve device 300, the plug will not interfere with the wellbore, and can, at the same time, completely block the circulation hole 321 from the outside to prevent impurities, such as cement or the like, from entering the circulation hole 321. It would be readily understood that the outer surface of the plug can further be recessed relative to the outer surface of the outer cylinder 302 in the radial direction, which can also prevent sand and cement from entering the area between the inner cylinder 306 and the outer cylinder 302 through the circulation hole 321. It would be also readily understood that the cross section of the protective element 304 can be in different structural forms, for example, an oval, a square or a polygon, according to different shapes of the circulation holes 321.

Figure 9:
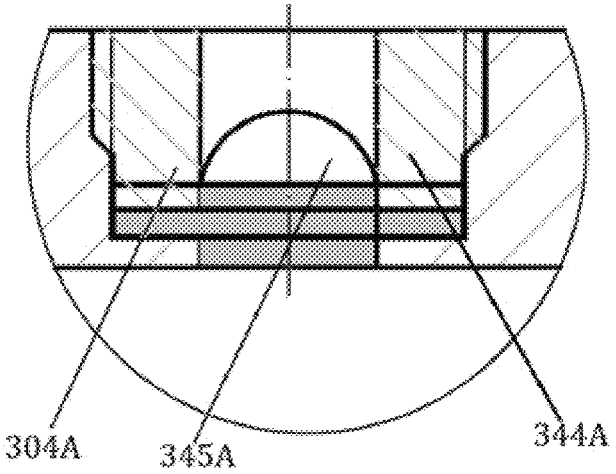
FIG. 9 shows an enlarged view of area A in FIG. 6 in a further form.

In another embodiment, the protective element 304 may also be configured as a breakable disk 304A arranged in the circulation hole 321, as shown in FIG. 9. The breakable disk 304A includes a main body portion 344A fixedly connected with the circulation hole 321, and a disk portion 345A that can be ruptured so that the inside and outside of the circulation hole 321 communicate with each other. In operation, after the inner cylinder 306 moves downward, the pressure is built up to force the disk portion 345A of the breakable disk 304A to be ruptured, thereby exposing the circulation hole 321 for later fracturing operation.

According to the present invention, lubricating grease may be filled in the circulation hole 321 between the protective element 304 and the inner cylinder 306. For example, in the structure shown in FIG. 7, a space of the circulation hole 321 radially inward of the plug (i.e., the lower part of the circulation hole 321 in FIG. 7) may be filled with lubricating grease. The lubricating grease can be, for example, lubricating gel.

As an additional arrangement, according to the present invention, a clearance (not shown) in communication with the circulation hole 321 may be provided between the outer cylinder 302 and the inner cylinder 306 and outside the axial ends of the circulation hole 321. The clearance is similar as the clearance 8 as mentioned in the first embodiment of the present invention in terms of structure and function, which will not be repeated here.

According to another aspect of the present invention, a fracturing string (not shown) is provided, which includes a plurality of sliding sleeve devices 100 according to the first embodiment of the present invention, a plurality of sliding sleeve devices 200 according to the second embodiment of the present invention, or a plurality of sliding sleeve devices 300 according to the third embodiment of the present invention. During the fracturing operation, these sliding sleeve devices are opened step by step for fracturing operation of separate layers.

While the present invention has been described above with reference to the exemplary embodiments, various modifications may be made and components may be replaced with equivalents thereof without departing from the scope of the present invention. In particular, as long as there is no structural conflict, each technical feature mentioned in each embodiment can be combined in any manner. The present invention is not limited to the specific embodiments disclosed herein, but includes all technical solutions falling within the scope of the claims.

The invention claimed is:

1. A sliding sleeve device, comprising:

an outer cylinder having a circulation hole disposed in a wall of the outer cylinder; and an inner cylinder arranged in an inner cavity of the outer cylinder, wherein the inner cylinder is movable between an initial state and a first state, wherein in the initial state, the inner cylinder is disposed in an initial location and closes the circulation hole from the inner cavity of the outer cylinder, and in the first state, the inner cylinder is disposed in a first location and thereby exposes the circulation hole to the inner cavity of the outer cylinder, wherein the circulation hole is filled with a lubricating grease and is covered by a protective cover disposed away from the inner cylinder, and wherein an outer wall of the inner cylinder has a recess that is exposed to the circulation hole so as to allow the lubricating grease to enter the recess in the initial state.

2. The sliding sleeve device according to claim 1, wherein the circulation hole comprises a first step and a second step formed on an outer wall of the outer cylinder, wherein the first step and the second step are opposite to each other across the circulation hole and the protective cover is supported on the first step and the second step.

3. The sliding sleeve device according to claim 2, wherein the protective cover is configured to rupture under pressure.

4. The sliding sleeve device according to claim 3, wherein the protective cover is a disk having a main body portion fixedly connected to the circulation hole, and a disk portion that is breakable under pressure.

5. The sliding sleeve device according to claim 1, wherein the protective cover is a heat-shrinkable cover or a vulcanized rubber sleeve.

6. The sliding sleeve device according to claim 1, wherein the protective cover is a resin cover.

7. The sliding sleeve device according to claim 1, wherein a clearance is provided between the outer cylinder and the inner cylinder, and the clearance is in fluid communication with the circulation hole.

8. The sliding sleeve device according to claim 7, wherein the clearance is an enlarged hole formed on the inner wall of the outer cylinder, the enlarged hole comprising a sloping surface so that the clearance is narrowed in a direction away from the circulation hole.

* * * * *